United States Patent [19]

Fehling

[11] Patent Number: 4,841,860

[45] Date of Patent: Jun. 27, 1989

[54] SELF-INKING STAMP FOR PERFORMING AN INKING UPSTROKE

[75] Inventor: Paul Fehling, Wels, Austria

[73] Assignee: Walter Just Gesellschaft m.b.H., Wels, Austria

[21] Appl. No.: 287,341

[22] Filed: Dec. 20, 1988

[30] Foreign Application Priority Data

Jan. 25, 1988 [AT] Austria ..... 126/88

[51] Int. Cl.[4] ..... B41K 1/42

[52] U.S. Cl. ..... 101/334

[58] Field of Search ..... 101/405, 406, 382.1, 101/334, 104, 327

[56] References Cited

U.S. PATENT DOCUMENTS

| | | | |
|---|---|---|---|
| 233,285 | 10/1980 | Scotford | 101/334 |
| 417,278 | 12/1989 | Pringle | 101/104 |
| 1,196,512 | 8/1916 | Brookman | 101/405 |
| 1,607,849 | 11/1926 | Schulz | 101/405 |
| 2,079,080 | 5/1973 | Melind | 101/334 |
| 2,312,727 | 3/1943 | Nisenson | 101/334 |
| 2,950,676 | 8/1960 | Weissman et al. | 101/334 |
| 3,714,894 | 2/1973 | Robinson | 101/334 |
| 4,432,281 | 2/1984 | Wall et al. | 101/334 |
| 4,697,513 | 10/1987 | Faber | 101/405 |

*Primary Examiner*—E. H. Eickholt
*Attorney, Agent, or Firm*—Kurt Kelman

[57] ABSTRACT

A self-inking stamp for performing an inking upstroke comprises a base part, which is adapted to be placed on the surface to be stamped and comprising an ink pad, which is opposite to the bottom surface of the base part, a type plate carrier, which is disposed in the base part and adapted to be reciprocated between the ink pad and the bottom surface of the base part and to be inverted during each stroke, and an actuating member, which embraces the base part with two side legs, which are guided on the narrow side walls of the base part, and is adapted to be displaced against spring force toward the bottom surface of the base part and the free ends of the side legs of which are interconnected by a pivot, which extends through slots formed in the narrow side walls of the base part. In such stamp, the type plate carrier is pivoted on said pivot, which is formed with laterally disposed longitudinal track grooves for receiving respective guide pins, constraining straps are provided between the type plate carrier and the narrow side walls of the base part, each of said straps is formed with a cam slot, through which said pivot extends, each of said straps carries one of said guide pins adjacent to the center of said cam slot, and said constraining straps are pivoted in the narrow side walls of the base part by pivot pins disposed above the associated cam slot. In order to facilitate the assembling, the two constraining straps are interconnected by a crossbar, which extends above the ink pad, to form an integral U-shaped member, and the pivot pins are carried by tongues, which have been lanced from the constraining straps and are resilient in the axial direction of the pivot pins.

2 Claims, 3 Drawing Sheets

SELF-INKING STAMP FOR PERFORMING AN INKING UPSTROKE

BACKGROUND OF THE INVENTION

1. Field of the Invention

This invention relates to a self-inking stamp for performing an inking upstroke, comprising a base part, which is adapted to be placed on the surface to be stamped and comprising an ink pad, which is opposite to the bottom surface of the base part, a type plate carrier, which is disposed in the base part and adapted to be reciprocated between the ink pad and the bottom surface of the base part and to be inverted during each stroke, and an actuating member, which embraces the base part with two side legs, which are guided on the narrow side walls of the base part, and is adapted to be displaced against spring force toward the bottom surface of the base part and the free ends of the side legs of which are interconnected by a pivot, which extends through slots formed in the narrow side walls of the base part, wherein the type plate carrier is pivoted on said pivot, which is formed with laterally disposed longitudinal track grooves for receiving respective guide pins, constraining straps are provided between the type plate carrier and the narrow side walls of the base part, each of said straps is formed with a cam slot, through which said pivot extends, each of said straps carries one of said guide pins adjacent to the center of said cam slot, and said constraining straps are pivoted in the narrow side walls of the base part by pivot pins disposed above the associated cam slot.

2. Description of the Prior Art

Such self-inking stamps have been known in practice for a very long time. As the actuating member is displaced against spring force toward the bottom surface of the base part, the pivot for the type carrier, which pivot connects the free ends of the side legs of the actuating member, will move in the slots of the narrow side walls of the base part and also in the cam slots of the two constraining straps, which owing to the curved shape of the cam slots perform an oscillating pivotal motion. Because guide pins are carried by said straps adjacent to the center of the cam slots and extend into the laterally disposed longitudinal track grooves of the type plate carrier, which is pivoted on the pivot and is moved by said pivot to the bottom surface of the base part, that type plate carrier is also pivoted about the pivot so that the type plate, which in a position of a rest faced away from the bottom surface of the base part and was in contact with the ink pad, is inverted to a position in which it faces the surface to be stamped and is forced against said surface. As the actuating member is returned by spring action, the type plate carrier is also swung back through 180° so that the type plate again contacts the ink pad.

In the prior art, each constraining strap constitutes a separate part, which can be mounted only with difficulty. Each strap must individually be inserted into the boxlike base part. This is complicated because the base part has an access opening only in its bottom and care must be taken that the pivot pin of each strap is received by the associated bearing hole in the narrow side wall of the base part. Even when the pivot pin has been received by the associated bearing hole, the strap carrying that pivot pin has not yet been fixed but must be urged from the inside against the narrow side wall until the type plate carrier has been inserted and now prevents a separation of the two straps from the narrow side walls. Moreover, the two constraining straps of a stamp cannot be interchanged but are associated with respective ones of the narrow side walls because otherwise the cam slots on both sides would be curved in mutually opposite senses. For this reason care must be taken during the assembling of a stamp that the constraining straps are properly selected and associated. As a result, the assembling of the self-inking stamp is a rather complicated operation.

SUMMARY OF THE INVENTION

For this reason it is an object of the invention to eliminate that disadvantage and so to improve the self-inking stamp that it can be assembled more easily.

That object is accomplished in accordance with the invention in that the two constraining straps are interconnected by a crossbar, which extends above the ink pad, to form an integral U-shaped member, and the pivot pins are carried by tongues, which have been lanced from the constraining straps and are resilient in the axial direction of the pivot pins.

In such a stamp the two constraining straps are integrated in a single member, which can easily be inserted into the boxlike base part through the opening formed in its bottom. During that insertion the tongues carrying the pivot pins are initially inwardly deflected and subsequently snap outwardly as soon as the pivot pins register with the associated bearing holes in the narrow side walls of the base part. In that position the U-shaped member is sufficiently held in position and need not be urged against the inside surfaces of the narrow side walls and no difficulty is involved in the insertion of the type plate carrier. No care need be taken that the U-shaped member comprising the two constraining straps will be inserted in the proper lateral position because the positions of the two cam slots relative to each other are inherently determined.

Within the scope of the invention the end faces of the pivot pins are chambered on that side which faces the crossbar to form run-up surfaces for engagement by the bottom edges of the narrow side walls and said run-up surfaces will facilitate the inward deflection of the tongues which carry the pivot pins so that the insertion of the U-shaped member will be facilitated.

DETAILED DESCRIPTION OF THE PREFERRED EMBODIMENT

Figure 1:
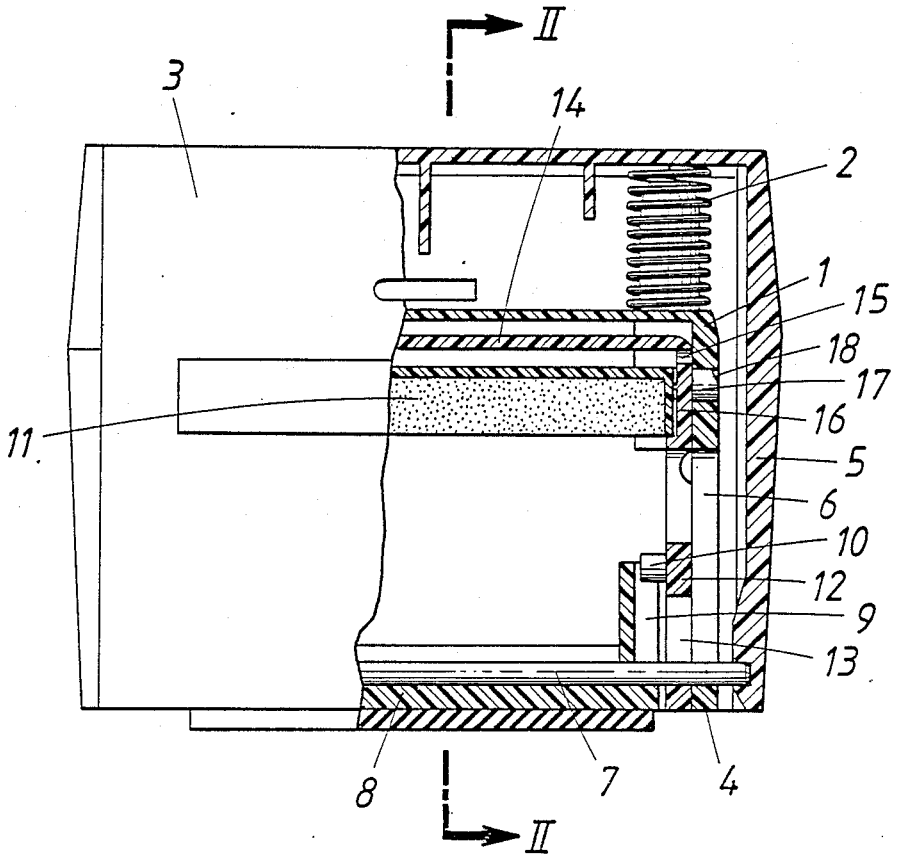
FIG. 1 is a side elevation, partly broken away, and shows a self-inking stamp in stamping position.
Figure 2:
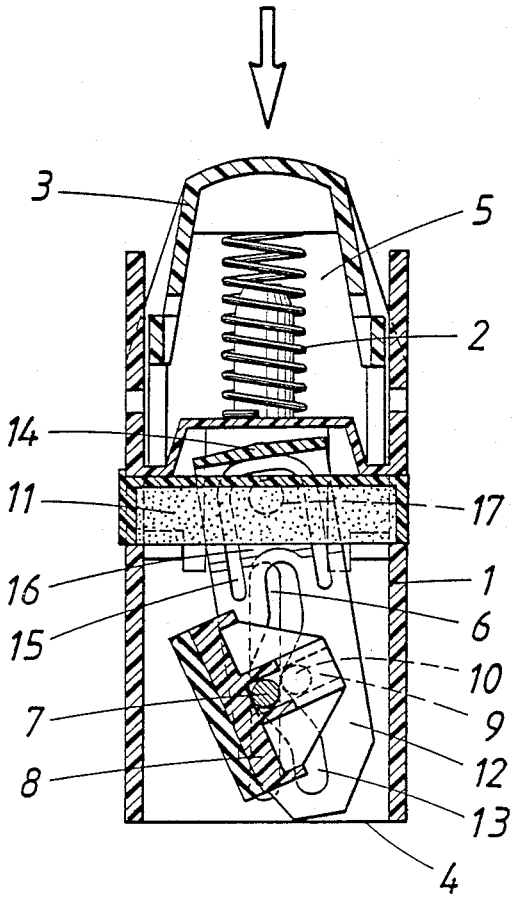
FIG. 2 is a transverse sectional view that is taken on line II—II in FIG. 1 and shows the stamp in a position in which the actuating member has been forced down through about one-half of its stroke.

An illustrative embodiment of the invention will now be described with reference to the drawing.

The self-inking stamp comprises a base part, which is generally designated 1, and an actuating part 3, which is adapted to be forced down relative to the base part 1 against the force of two helical compression springs 2 and to be returned by said springs. The base part 1 is box-shaped and has a bottom surface 4, which defines an aperture. The side legs of the actuating member 3 are guided on the narrow side walls of the base part 1. The two narrow side walls of the base part are formed with respective vertical slots 6, which are horizontally aligned. The free ends of the side legs 5 of the actuating member 3 are interconnected by a pivot 7, which extends through the two slots 6. A type plate carrier 8 is pivoted on the pivot 7 and is formed adjacent to each of the narrow side walls with a longitudinal track groove 9, which receives a guide pin 10. An ink pad 11 which is opposite to the bottom surface 4 of the base part 1 has slidably been inserted into the latter near its top end.

Figure 3:
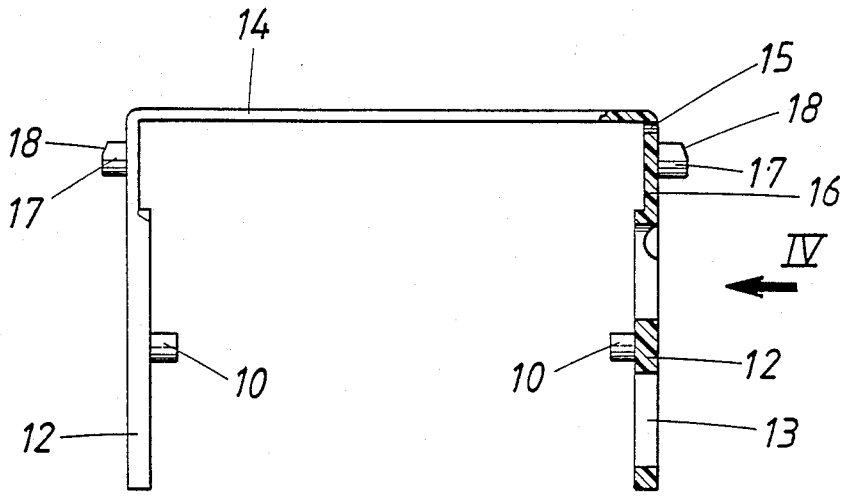
FIG. 3 is a side elevation, which is partly cutaway and shows the U-shaped member that comprises the two constraining straps.
Figure 4:
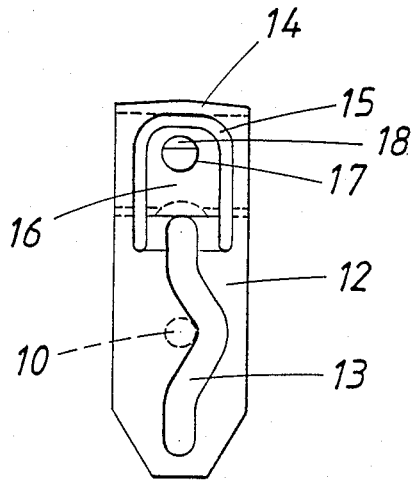
FIG. 4 is an end view taken in the direction of the arrow in FIG. 3.

The guide pins 10 are carried by respective constraining straps 12, which are formed with respective cam slots 13, through which the pivot 7 also extends. Each guide pin 10 is disposed near the center of the associated cam slot. As is particularly apparent from FIG. 3 the two constraining straps 12 are interconnected by a crossbar 14 so that a U-shaped member is obtained. Each constraining strap 12 is formed with a tongue 16, which has been lanced to leave a slot 15. Each tongue 16 carries a pivot pin 17 for pivoting the U-shaped member 12, 14 to the adjacent narrow side wall of the base part 1. The crossbar 14 extends above the ink pad 11 and cannot hinder the movement of the constraining straps 12 and of the type plate carrier 8. On that side which faces the crossbar 14, i.e., at the top, the end face of each pivot pin 17 is formed with a chamfer 18.

It is apparent that an actuating mechanism for reciprocating the type plate carrier 8 between the ink pad 11 and the bottom surface 4 of the base part 1 in downward and upward strokes and for inverting said type plate carrier during each of said strokes. Said mechanism comprises the actuating member 3, the springs 2, the horizontal pivot 7, and the constraining straps 12.

When it is desired to assemble the stamp the member which is constituted by the two constraining straps 12 and the crossbar 14 is inserted into the base part 1 from below. Owing to the chamfers 18, which constitute run-up surfaces for the bottom edges of the narrow side walls, the tongues 16 are deflected inwardly during said operation and remain in that friendly deflected position until the pivot pins 17 snap into associated bearing holes formed in the narrow side walls of the base part 1.

I claim:

1. In a self-inking stamp for performing an inking upstroke comprising a base part comprising a bottom surface, which defines an aperture, and two vertical narrow side walls formed with respective, horizontally aligned, vertical slots and with respective, horizontally aligned bearing holes, a downwardly facing ink pad, which is fixed to and spaced in said base part above said bottom, a type plate carrier, which is movably mounted in said base part between said bottom surface and said ink pad and is formed with a longitudinal track groove adjacent to and open to each of said narrow side walls, and an actuating mechanism for reciprocating said type plate carrier between said ink pad and said bottom in downward and upward strokes and for inverting said type plate carrier during each of said strokes, which mechanism comprises an actuating member which is vertically movable relative to said base part and has two horizontally aligned side legs disposed on the outside of respective ones of said narrow side walls and having free bottom ends, spring means urging said actuating member upwardly, a horizontal pivot extending through said slots and connected to said free ends of said legs, said type plate carrier being pivoted on said pivot, and two constraining straps, which extend between said type plate carrier and respective ones of said narrow side walls and are formed each with a cam slot, each of said straps carrying a pivot pin that is disposed above said cam slot and pivoted in one of said bearing holes and a guide pin disposed adjacent to the center of said cam slot and slidably extending into one of said track grooves, the improvement residing in that said constraining straps are interconnected by a crossbar, which is offset from said pivot pins and extends in said base part above said ink pad, and each of said straps is formed with a lanced tongue, which carries said pivot pin and axially urges said pivot pin toward the adjacent one of said longitudinal side walls.

2. The improvement set forth in claim 1, wherein each of said pivot pins has an end face which is chamfered at the top.

* * * * *